US011837417B2

(12) United States Patent
Taborsky et al.

(10) Patent No.: US 11,837,417 B2
(45) Date of Patent: Dec. 5, 2023

(54) STACKABLE LOW-PROFILE ELECTRICAL CONTACT BLOCK

(71) Applicant: Schneider Electric Industries SAS, Rueil Malmaison (FR)

(72) Inventors: Isabelle Taborsky, Barbezieux-Saint-Hilaire (FR); Praveen Kumar Deevarpalli, L'Isle d'espagnac (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 39 days.

(21) Appl. No.: 17/509,118

(22) Filed: Oct. 25, 2021

(65) Prior Publication Data

US 2022/0139646 A1 May 5, 2022

(30) Foreign Application Priority Data

Oct. 29, 2020 (EP) ..... 20306297

(51) Int. Cl.
*H01H 13/50* (2006.01)
*H01H 1/20* (2006.01)
(Continued)

(52) U.S. Cl.
CPC ..... *H01H 13/503* (2013.01); *H01H 1/20* (2013.01); *H01H 1/242* (2013.01); *H01H 13/52* (2013.01); *H01H 2001/223* (2013.01)

(58) Field of Classification Search
CPC ..... H01H 13/503; H01H 1/20; H01H 1/242; H01H 13/52; H01H 2001/223; H01R 13/629; H01R 13/627
See application file for complete search history.

(56) References Cited

U.S. PATENT DOCUMENTS 4,255,633 A * 3/1981 Johnston ..... H01H 15/00 200/18
6,667,448 B2 * 12/2003 Schaefer ..... H01H 11/0012 200/243
2016/0307710 A1 10/2016 Bruchschmidt et al.

FOREIGN PATENT DOCUMENTS

DE 19856678 A1 4/2001
WO 2015091497 A1 6/2015

OTHER PUBLICATIONS

European Search Report and Writtten Opinion dated Apr. 1, 2021 for corresponding European Patent Application No. EP20306297.1, 7 pages.

* cited by examiner

*Primary Examiner* — Ahmed M Saeed
(74) *Attorney, Agent, or Firm* — Locke Lord LLP

(57) ABSTRACT

A stackable electrical contact block includes a housing, the housing having a top and bottom side and accommodating a first and second electrical terminal, an actuation pusher adapted to move from a resting position to an actuated position to break the contact between the first and second terminals, the actuation pusher having a head protruding from the top side, a clearance below the actuation pusher, and a return spring biasing the actuation pusher towards its resting position, a bottom end of the return spring extending into the clearance. The housing's bottom side is a connection interface with an entrance providing access to the clearance. A central part of the clearance is taken up by the bottom end of the return spring, and a peripheral part is a space for receiving the actuation head of a component connected to the contact block via the connection interface.

10 Claims, 6 Drawing Sheets

(51) Int. Cl.

| | |
|---|---|
| ***H01H 1/24*** | (2006.01) |
| ***H01H 13/52*** | (2006.01) |
| *H01H 1/22* | (2006.01) |

STACKABLE LOW-PROFILE ELECTRICAL CONTACT BLOCK

TECHNICAL FIELD

This disclosure pertains to a stackable electrical contact block comprising a housing that delimits its volume, wherein the housing has a top side and an opposite bottom side, wherein the following elements are present within the housing:

- a first and second electrical terminal;
- an actuation pusher adapted to move between a resting position and an actuated position in order to establish or break an electrical contact between the first and second terminals, the actuation pusher having an actuation head, which, in the resting position, protrudes from the housing's top side;
- a clearance below the actuation pusher, when the actuation pusher is in its resting position; and
- a return spring biasing the actuation pusher towards its resting position, a bottom end of the return spring extending into the clearance.

BACKGROUND ART

This type of electrical contact block is known. An example is disclosed in FIGS. 1 and 8 to 10 of WO 2015/091497 A1.

Such a contact block has the advantage of a low profile. However, it is not fully stackable, which limits its use as a module, for example as part of a push button assembly. In particular, this prior art contact block cannot be used as an upper or intermediate member of a contact block stack.

SUMMARY

In view of the above, it is an object of the present disclosure to provide a low-profile electrical contact block, which is fully stackable.

According to the present disclosure, this object is achieved with an electrical contact block as defined above in § [0001], which is characterised in that the housing's bottom side is configured as a connection interface with an entrance providing access to the clearance, for connecting the contact block to another component, and in that a central part of the clearance is taken up by the bottom end of the return spring, and a peripheral part of the clearance, which surrounds the central part, is an actuation head receiving space adapted for receiving the actuation head of a component connected to the contact block via the connection interface.

By making the housing's bottom side into a connection interface, the contact block of the present disclosure can be easily stacked onto another component, and in particular onto another contact block. During stacking, thanks to the bottom side entrance, the actuation head of the lower contact block can be inserted into the clearance of the upper contact block. As a result, the actuation head of the lower contact block is arranged below the pusher of the upper contact block so that it can cooperate therewith. By locating the bottom end of the return spring in the centre of the clearance, a peripheral part of the clearance remains unobstructed, which allows the insertion of the actuation head of the lower contact block into the upper contact block.

The following features can be optionally implemented, separately or in combination one with the others:

- the actuation pusher has an elongate shape defining a central longitudinal pusher axis, wherein the return spring has a cylindrical shape defining a central longitudinal spring axis, and wherein both axes essentially coincide;
- a mobile electrical contact bridge for establishing and breaking the electrical contact between the first and second terminals, wherein the contact bridge is accommodated in the actuation pusher, and wherein the return spring extends through the contact bridge;
- a contact spring biasing the contact bridge towards the first and second terminals, wherein the return spring extends through the contact spring;
- the contact spring and the return spring are arranged coaxially;
- the contact bridge has a central through hole, which is traversed by the return spring;
- the entrance consists of two parallel slits adapted for receiving the prongs of a fork-shaped actuation head;
- a spring supporting section formed in the housing's bottom side for supporting the bottom end of the return spring, wherein the spring supporting section is located in-between the two parallel slits;
- the actuation pusher, when viewed from the side, essentially has the shape of the letter H;
- the actuation head of the actuation pusher is fork-shaped;
- the ratio between the housing's height and length is less than 0.4.

BRIEF DESCRIPTION OF THE DRAWINGS

These and other features and advantages are detailed in the following description of preferred embodiments and in the accompanying figures, of which.

DESCRIPTION OF EMBODIMENTS

Reference is first made to FIGS. 1 to 4. These figures show an embodiment 100 of a stackable electrical contact block according to the present disclosure.

Figure 11:
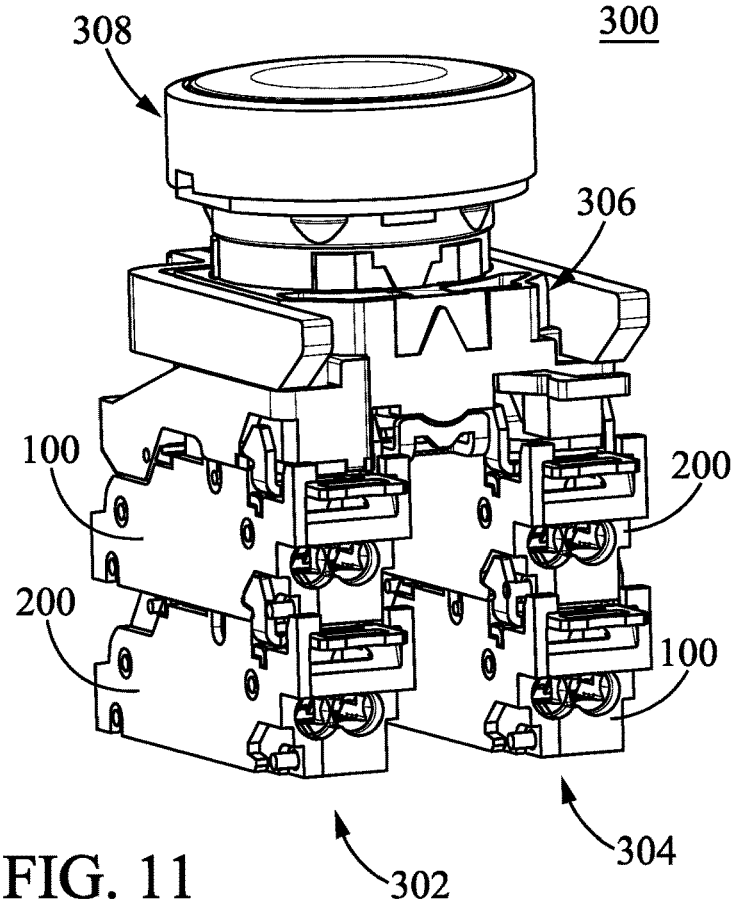
FIG. 11 is a perspective view of a pushbutton assembly according to the present disclosure, including four electrical contact blocks.

The electrical contact block 100 is designed to be integrated into a control unit, such as an industrial pushbutton assembly (cf. FIG. 11). By actuating the electrical contact block 100, one can break an electrical contact between two electrical terminals arranged within the contact block. In industrial applications, this allows to stop the supply of electrical current to an electrically driven installation. For example, the electrical contact block 100 may be used as part of an emergency stop pushbutton, e.g. to stop a production line in case of a hazard.

Generally, there are two types of electrical contact blocks, namely electrical contact blocks that are normally open and electrical contact blocks that are normally closed (the respective shorthand is NO for "normally open", and NC for "normally closed").

The electrical contact block 100 shown in FIGS. 1 to 4 is of the NC-type. It is to be understood that the present disclosure not only covers NC-type contact blocks, but also NO-type contact blocks.

Figure 1:
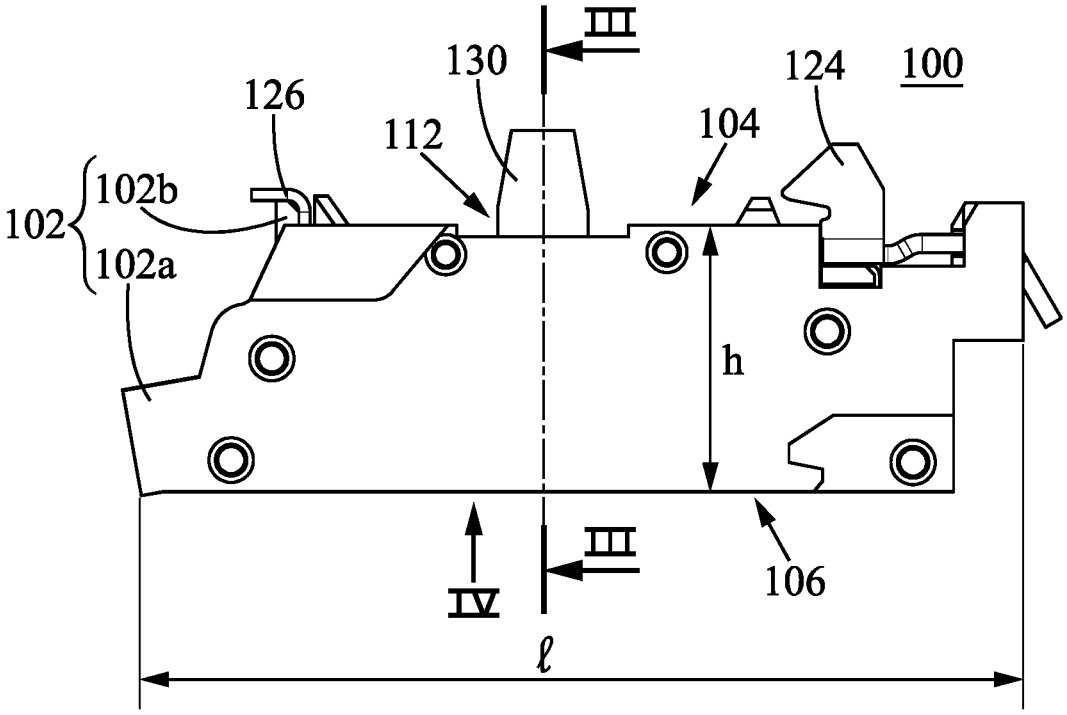
FIG. 1 is a side view of an electrical contact block of the normally closed type according to the present disclosure.
Figure 2:
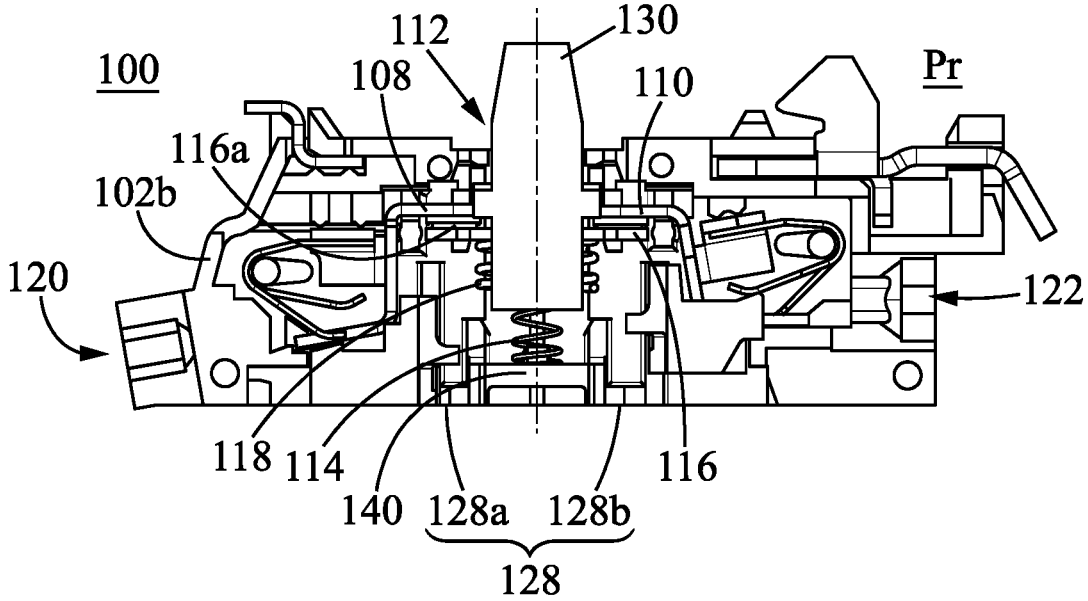
FIG. 2 is a side view similar to that of FIG. 1, where the housing cover is removed.

With reference to FIGS. 1 to 4, the electrical contact block 100 comprises a housing 102 that delimits its overall volume. The housing 102 consists of a housing cover 102*a* and a housing main body 102*b*. The cover 102*a* is fitted onto a lateral side of the main body 102*b*. In FIG. 2, the cover 102*a* is removed in order to show the internal structure of the electrical contact block 100. The housing 102 has a top side 104 and an opposite bottom side 106.

The electrical contact block 100 includes the following components, which are all present within the housing 102:

first and second electrical terminals 108 and 110, an actuation pusher 112, a return spring 114, a mobile electrical contact bridge 116, a contact spring 118; and two wire inlet pairs 120 and 122.

Figure 7:
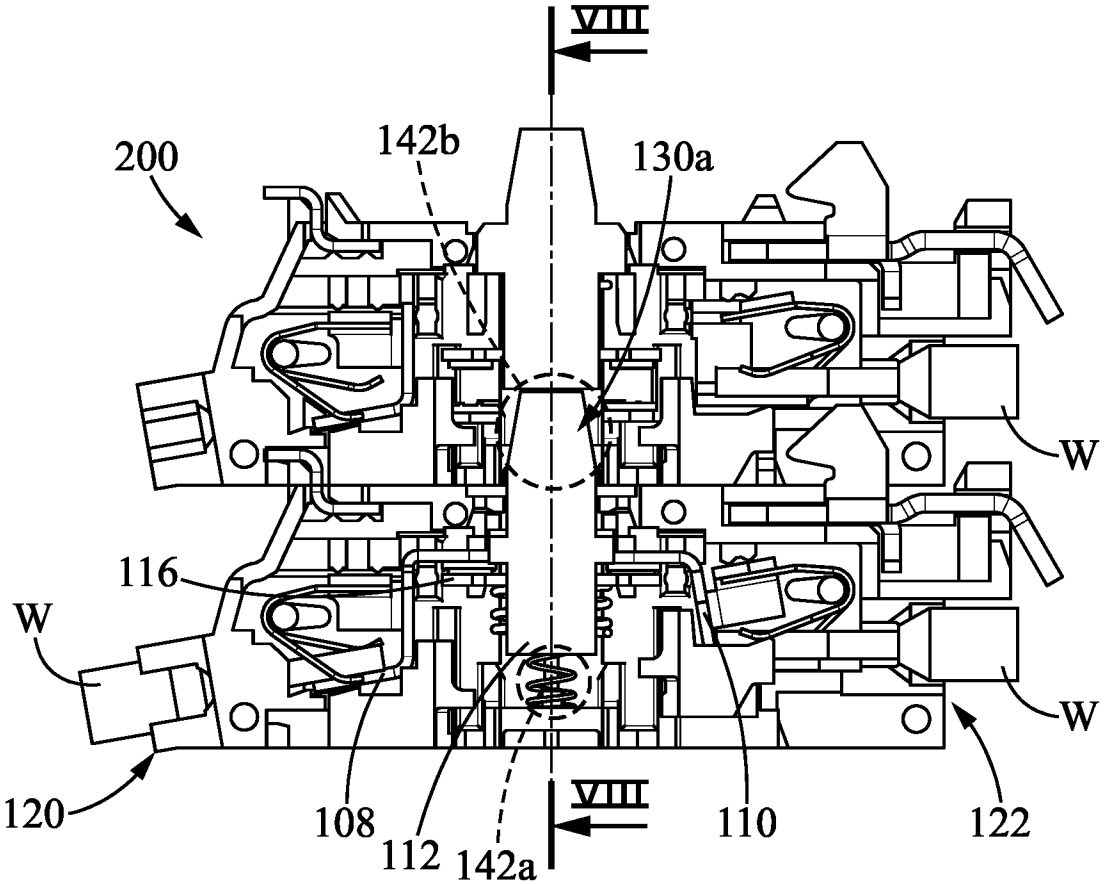
FIG. 7 is a stack of two electrical contact blocks of the present disclosure, one of the normally closed and one of the normally open type.
Figure 10:
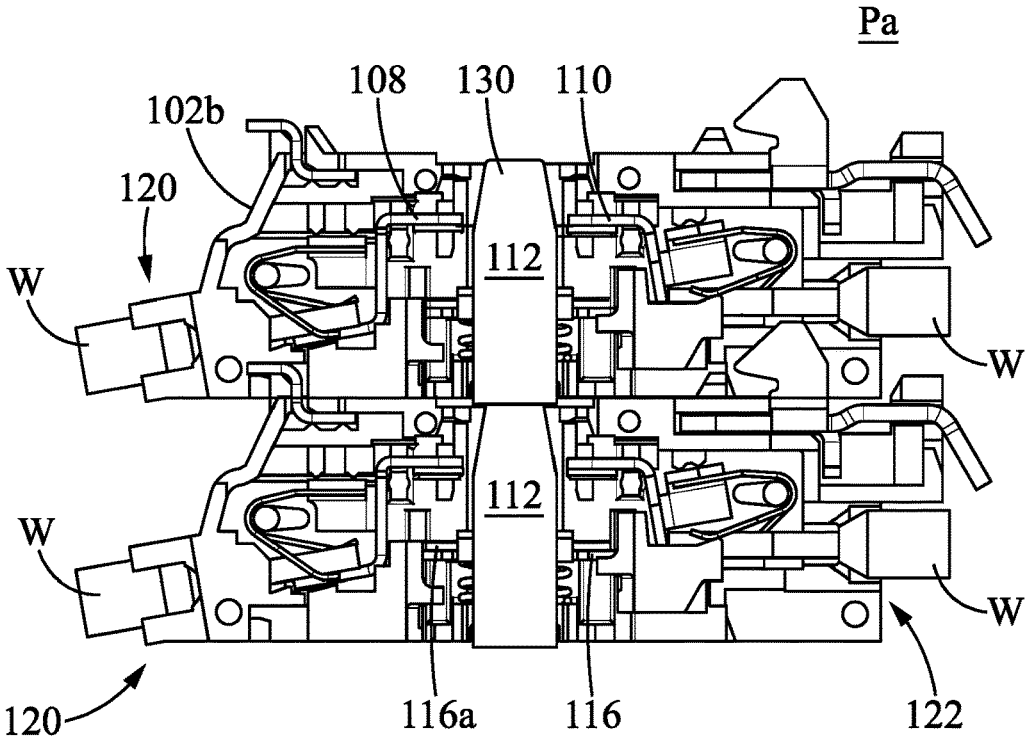
FIG. 10 is a side view of a stack of two electrical contact blocks of the present disclosure, both being of the normally closed type, and both being in their actuated position.

The two wire inlet pairs 120 and 122 are located on opposite sides of the housing 102. In other words, a first side of the housing 102 has two wire inlets, and a second opposite side of the housing 102 equally has two wire inlets. In the figures, only one wire inlet of each pair 120, 122 is visible on each side of the housing 102. FIGS. 7 and 10 illustrate the electrical contact block 100 with inserted electrical wires W. When inserted, the wires W are in electrical contact with one of the two terminals 108, 110.

The bottom side 106 and the top side 104 of the housing 102 are each configured as a connection interface for connecting the contact block 100 to another component. In this way, the contact block 100 can be stacked on to, for example, other contact blocks. Likewise, another contact block can be stacked on top of the illustrated contact block 100. This is shown in FIGS. 7 to 10. Accordingly, the electrical contact block 100 can be assembled with other components in order to build a control device such as an emergency stop pushbutton assembly.

When another contact block is mounted onto the top side 104 of the contact block 100, it is fastened thereto with the help of a double hook 124 and an opposite fastening shoe 126.

Figure 4:
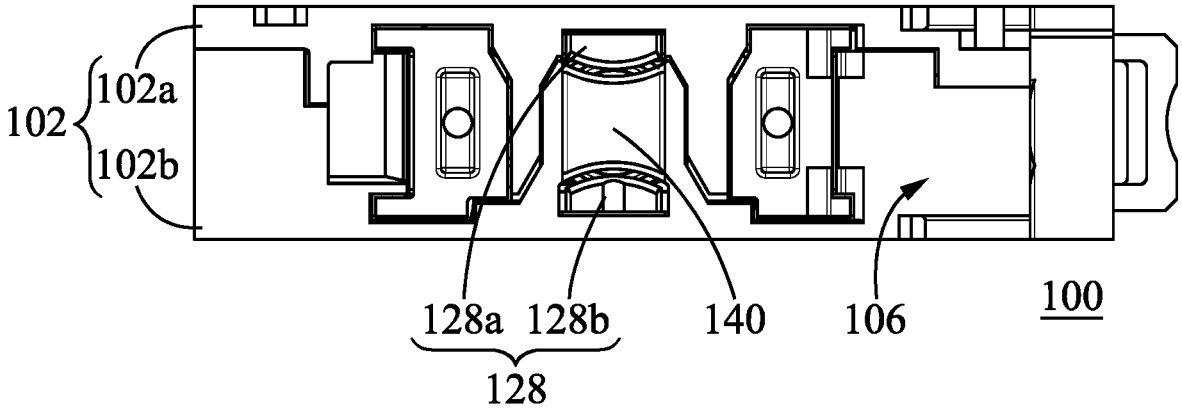
FIG. 4 is a bottom view, according to the arrow IV in FIG. 1.

The bottom connection interface, i.e. the housing's bottom side 106 has an entrance 128, see FIG. 4. Preferably, the entrance consists of two parallel slits 128*a* and 128*b*.

The actuation pusher 112 can move between a resting position Pr and an actuated position Pa in order to establish a break an electrical contact between the first and second terminals 108 and 110. Since the contact block illustrated in FIGS. 1 to 4 is of the NC-type, the resting position Pr is a closed position where the contact bridge 116 bridges the gap between the two electrical terminals 108 and 110. In this closed position, an electrical current can flow from one terminal to the other. All figures except FIG. 10 show the actuation pusher 112 in its closed or resting position Pr. In FIG. 10, the actuation pusher 112 is depressed and positioned in its actuated position Pa.

Figure 5:
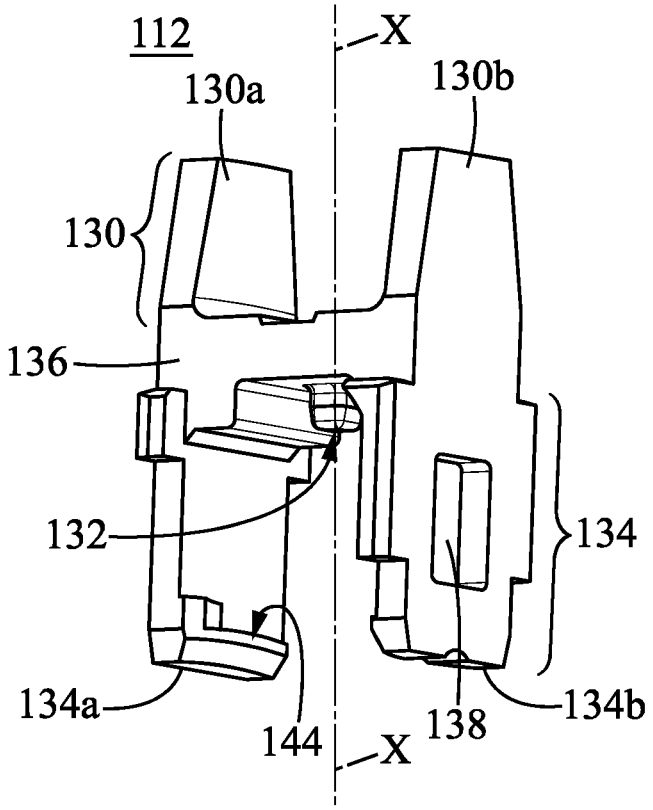
FIG. 5 is a perspective view of an actuation pusher according to the present disclosure.

The actuation pusher 112 is represented on its own in FIG. 5. It has an actuation head 130, a cross-link 136, a spring end receiving zone 132 located on the cross-link 136, and a two-pronged (left & right) bridge guiding base 134. The actuation head 130 and the base 134 are connected via the cross-link 136. The actuation pusher 112 has an elongated shape, which defines a central longitudinal pusher axis X-X. As can be seen for example in FIG. 3, the actuation pusher 112, when viewed from the side, essentially has the shape of the letter H. One will also note that the actuation head 130 of the actuation pusher 112 is fork shaped. The fork 130 has two prongs 130*a* and 130*b*.

The bridge guiding base 134 also has a fork shape with a first prong 134*a* and a second prong 134*b*. As apparent from FIGS. 2 and 3, the mobile contact bridge 116 is accommodated in-between the two base prongs 134*a* and 134*b*. Each prong 134*a*, 134*b* acts as an outer guiding wall for one side of the mobile bridge 116 so that the mobile bridge 116 can slide up and down within the actuation pusher 112.

The outer lateral walls of the first prong 134*a* act as guiding surfaces for guiding the sliding motion of the mobile bridge 116. A guiding slot 138 is arranged in the second prong 134*b*. The inner walls of the guiding slot 138 also act as guiding surfaces for guiding the sliding motion of the mobile bridge 116.

Figure 6:
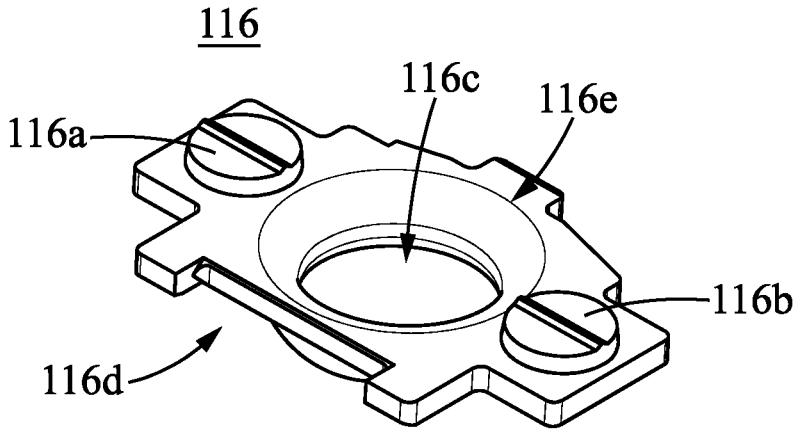
FIG. 6 is a perspective view of an electrical contact bridge according to the present disclosure.

Turning now to FIG. 6, the mobile electrical contact bridge 116 is a metallic element with two lateral electrical contact points 116*a* and 116*b*, a central through hole 116*c*, a guiding notch 116*d*, and a guiding protrusion 116*e*. The guiding notch 116*d* cooperates with the outer lateral walls of the slot-less guiding prong 134*a*. The guiding notch 116*d* and the outer lateral walls thus together form an outer guiding assembly. The guiding protrusion 116*e* fits into the guiding slot 138 of the second guiding prong 134*b*. Hence, the guiding protrusion 116*e* and the guiding slot 138 together form an inner guiding assembly. Overall, the sliding motion of the mobile bridge 116 is guided by two lateral guiding assemblies, namely the outer guiding assembly and the opposite inner guiding assembly.

Alternatively, the mobile bridge 116 may be guided by two outer guiding assemblies or two inner guiding assemblies. In the first case, both guiding prongs 134*a*, 134*b* will be slot-less and the mobile bridge 116 will have two opposite guiding notches 116*d*. In the second case, both guiding prongs 134*a*, 134*b* will have a guiding slot 138 and the mobile bridge 116 will have two opposite guiding protrusions 116*e*.

Each contact point 116*a*, 116*b* cooperates with one of the electrical terminals 108 and 110.

In the illustrated embodiments, the return spring 114 is a helicoidal compression spring. As apparent from FIG. 3, it has a bottom end 114*a* close to the housing's bottom side 106 and a top end 114*b* close to the housing's top side 104. The return spring 114 has a cylindrical shape, which defines a central longitudinal spring axis Y-Y. The longitudinal spring axis Y-Y coincides with the longitudinal pusher axis X-X. The return spring 114 extends through the contact bridge 116. More specifically, the return spring 114 traverses the central through-hole 116*c*. The function of the return spring 114 is to bias the actuation pusher 112 into its resting position Pr. To do so, its top end 114*b* pushes against the pusher 112, and its bottom end 114*a* pushes against the housing 102.

The top end 114*b* of the return spring 114 is received in the spring end receiving zone 132 of the actuation pusher 112. A spring supporting section 140 is formed in the housing's bottom side 106. The spring supporting section 140 supports the bottom end 114*a* of the return spring 114. As illustrated in FIG. 4, the spring supporting section 140 is located in-between the two parallel slits 128*a* and 128*b*.

Figure 8:
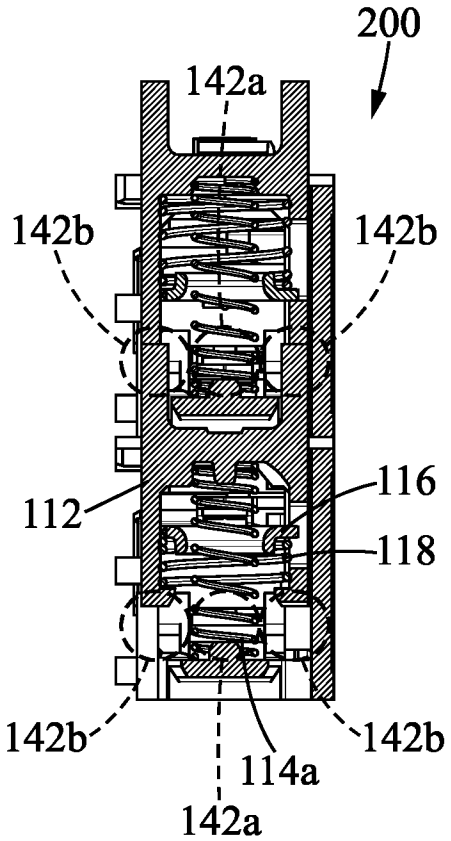
FIG. 8 is a cross-sectional view of the stack of FIG. 7, taken along line VIII VIII.
Figure 9:
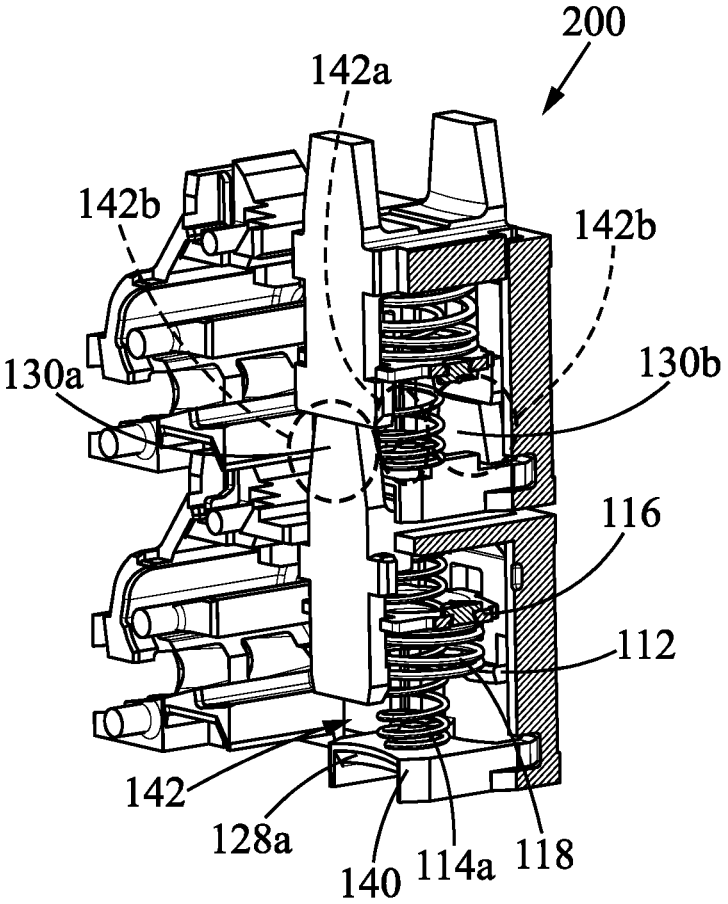
FIG. 9 is a perspective view of a detail of the stack of FIG. 7.

As best seen in FIG. 9, a clearance 142 is located below the actuation pusher 112, when the actuation pusher 112 is in its resting position Pr. The bottom end 114*a* of the return spring 114 extends into the clearance 142. The entrance 128, i.e. the two slits 128*a* and 128*b*, provide access to the clearance 142. A central part 142*a* of the clearance 142 is taken up by the bottom end 114*a* of the return spring 114. A peripheral part 142*b* of the clearance 142, which surrounds the central part 142*a*, is an actuation head receiving space. As can be seen in FIGS. 7 to 9, the actuation head receiving space 142*b* is adapted for receiving the actuation head 130 of a component connected to the contact block via its bottom side 106. The actuation head receiving space 142*b* is subdivided into two separate receiving zones. Each zone can receive one of the two prongs 130*a*, 130*b* of a fork shaped actuation head 130.

Figure 3:
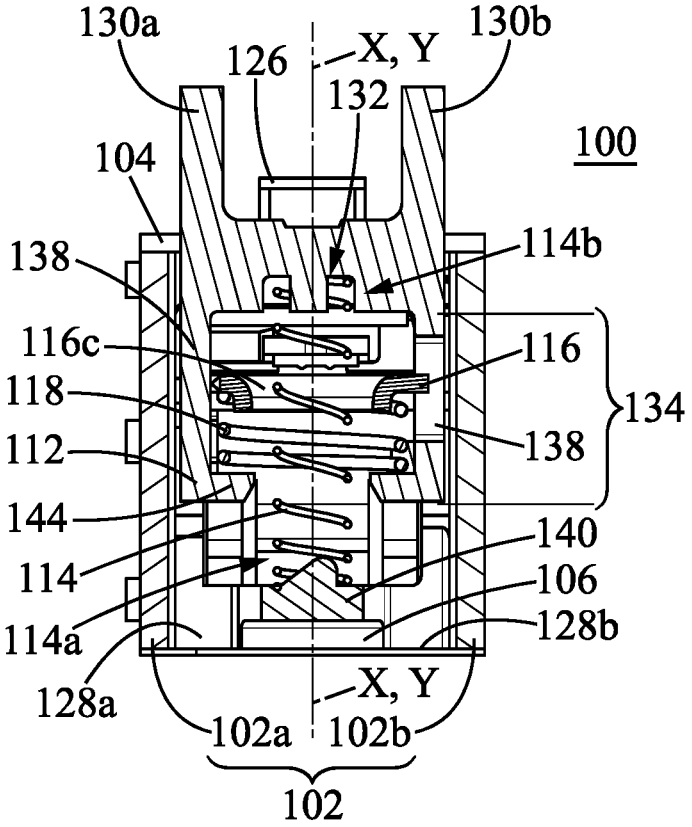
FIG. 3 is a cross-sectional view of the electrical contact block taken along line III-III of FIG. 1.

With reference to FIG. 2, the contact spring 118 biases the contact bridge 116 towards the first and second terminals 108 and 110. As seen in FIG. 3, the contact spring 118 is fitted into the base part 134 of the actuation pusher 112. The top portion of the contact spring 118 pushes against the bottom side of the contact bridge 116. The bottom portion of the contact spring 118 rests on a ledge 144 of the base part 134. In the illustrated embodiments, the contact spring 118 is a helicoidal compression spring. Accordingly, it has a cylindrical shape. As shown in FIG. 3, the return spring 114 extends through the contact spring 118. Preferably, the contact spring and the return spring are arranged coaxially. In this case, they share a common longitudinal axis Y-Y. Preferably, the diameter of the return spring 114 is smaller than the diameter of the contact spring 118.

We will now explain the operation of the electrical contact block 100. In the resting position Pr, the actuation head 130 protrudes from the housing's top side 104, cf. FIGS. 1 and 2. The electrical contact block 100 is then actuated by pushing the actuation pusher 112 into the housing 102. This is done by depressing the actuation head 130. The pressure exerted on the actuation head 130 has to be sufficient to overcome the opposing force exerted by the return spring 114. The actuation pusher 112 then moves towards the housing's bottom side 106 until it reaches its actuated position Pa shown in FIG. 10. In this position, the actuation head 130 is completely retracted into the housing 102. The mobile contact bridge 116, which moves in unison with the actuation pusher 112, is separated from the electrical terminals 108 and 110. Accordingly, the electrical contact between the first and second terminals 108, 110 is broken.

In order to attach a contact block to the bottom side 106 of the contact block 100, one has to insert the prongs 130*a*, 130*b* of the actuation head 130 of the contact block into the parallel slits 128*a*, 128*b* of the contact block 100. In this way, the prongs 130*a*, 130*b* are brought into the actuation head receiving space 142 of the contact block 100. As can be seen in FIGS. 7 to 9, where two contact blocks are assembled to form a stack, the two prongs 130*a*, 130*b* of the actuation head 130 of the lower contact block are arranged directly below the actuation pusher of the upper contact block. Accordingly, when the upper actuation pusher is depressed, the downward force is directly transmitted to the lower actuation pusher so that both contact blocks are actuated simultaneously.

FIGS. 7 to 9 show a stack where the upper contact block is a normally-open block 200 and the lower contact block is a normally-closed block. The scope of the present disclosure also extends to these NO-type contact blocks, which have the same inventive design as to the bottom side entrance, the clearance below the actuation pusher, and the arrangement of the return spring, the contact spring and the contact bridge.

FIG. 11 is a perspective view of a pushbutton assembly 300, including two stacks 302 and 304 of two contact blocks according to the present disclosure. The left stack 302 is made of an upper contact block 100 of the NC-type and a lower contact block 200 of the NO-type. The right stack 304 is made of an upper contact block 200 of the NO-type and a lower contact block 100 of the NC-type. Hence, the assembly 300 has a total of four contact blocks. With the help of a collar 306, the four contact blocks amounted to a pushbutton 308.

A particularity of the contact blocks 100, 200 of the present disclosure is their low profile. Indeed, typically, the ratio between the height h and the length l of the housing 102 of the contact block is less than 0.4 (cf. FIG. 1). Thanks to the small height h, more contact blocks 100, 200 can be assembled behind a collar 306 and still fit into a slim control panel.

The new contact block architecture described in the present disclosure is particularly suited to meet all current customer needs:

- The new contact blocks 100, 200 are compatible with state-of-the-art contact blocks. This means in particular that the new contact blocks 100, 200 can be stacked under existing contact blocks;
- The new contact blocks 100, 200 are fully stackable onto each other, regardless of the order of stacking;
- Compared to conventional contact blocks with their larger height, more of the new contact blocks 100, 200 of the present disclosure can be mounted into the same available head space.

The contact blocks 100, 200 of the present disclosure are also fully compliant with the industry safety standards regarding clearance and creepage distance.

This disclosure is not limited to the specific embodiments described herein, which are only examples. The invention encompasses every alternative that is still covered by the appended claims.

The invention claimed is:

1. A stackable electrical contact block comprising a housing that delimits its volume, wherein the housing has a top side and an opposite bottom side, wherein the following elements are present within the housing:

- a first and second electrical terminal;
- an actuation pusher adapted to move between a resting position and an actuated position in order to establish or break an electrical contact between the first and second terminals, the actuation pusher having an actuation head, which, in the resting position, protrudes from the housing's top side;
- a clearance below the actuation pusher, when the actuation pusher is in its resting position;
- a return spring biasing the actuation pusher towards its resting position, a bottom end of the return spring extending into the clearance; and
- a mobile electrical contact bridge for establishing and breaking the electrical contact between the first and second terminals,
  - wherein the contact bridge is accommodated in the actuation pusher, wherein the return spring extends through the contact bridge, wherein the housing's bottom side is configured as a connection interface with an entrance providing access to the clearance, for connecting the contact block to another component, and wherein a central part of the clearance is taken up by the bottom end of the return spring, and a peripheral part of the clearance, which surrounds the central part, is an actuation head receiving space adapted for receiving the actuation head of a component connected to the contact block via the connection interface.

2. The contact block of claim 1, wherein the actuation pusher has an elongate shape defining a central longitudinal pusher axis, wherein the return spring has a cylindrical shape defining a central longitudinal spring axis, and wherein both axes essentially coincide.

3. The contact block of claim 1, further comprising a contact spring biasing the contact bridge towards the first and second terminals, wherein the return spring extends through the contact spring.

4. The contact block of claim 3, wherein the contact spring and the return spring are arranged coaxially.

5. The contact block of claim 1, wherein the contact bridge has a central through hole, which is traversed by the return spring.

6. The contact block of claim 1, wherein the entrance comprises two parallel slits adapted for receiving the prongs of a fork-shaped actuation head.

7. The contact block of claim 6, further comprising a spring supporting section formed in the housing's bottom side for supporting the bottom end of the return spring, wherein the spring supporting section is located in-between the two parallel slits.

8. The contact block of claim 1, wherein the actuation pusher, when viewed from the side, essentially has the shape of the letter H.

9. The contact block of claim 1, wherein the actuation head of the actuation pusher is fork-shaped.

10. The contact block of claim 1, wherein the ratio between the housing's height and length is less than 0.4.

* * * * *